United States Patent [19]

Leone et al.

[11] Patent Number: 4,704,593

[45] Date of Patent: Nov. 3, 1987

[54] CIRCUIT BREAKER WITH ADJUSTABLE THERMAL MECHANISM

[75] Inventors: David A. Leone, Aliquippa; Douglas C. Marks, North Braddock, both of Pa.

[73] Assignee: Westinghouse Electric Corp., Pittsburgh, Pa.

[21] Appl. No.: 788,173

[22] Filed: Oct. 16, 1985

[51] Int. Cl.[4] ..... H01H 71/16

[52] U.S. Cl. ..... 337/82; 337/57; 335/45

[58] Field of Search ..... 337/57, 82, 94; 335/45, 335/42

[56] References Cited

U.S. PATENT DOCUMENTS 4,080,582 3/1978 Link ..... 335/45

*Primary Examiner*—Harold Broome

*Attorney, Agent, or Firm*—L. P. Johns

[57] ABSTRACT

A circuit breaker having means for varying the thermal rating characterized by a circuit breaker mechanism including a releasable cradle for automatically tripping contacts to an open position in response to overload current conditions. A trip bar movable in response to movement of a bimetal element and the tie bar including a movably mounted member having an inclined surface for adjusting the spacing between the bimetal element and the movable member.

9 Claims, 5 Drawing Figures

CIRCUIT BREAKER WITH ADJUSTABLE THERMAL MECHANISM

CROSS REFERENCE TO RELATED APPLICATION

This application is related to copending application Ser. No. 655,954, filed Sept. 28, 1984, the invention of D. A. Leone and D. C. Marks, assigned to the assignee of this application.

BACKGROUND OF THE INVENTION

1. Field of the Invention:

This invention relates to a circuit breaker with integral thermal tripping elements and, more particularly, to an adjustable thermal mechanism therefor.

2. Description of the Prior Art:

Due to the increasing use of electrical circuit breakers, there has been an increase in the types of circuit breakers. For economic reasons, it has become impractical to provide circuit breakers with ampere ratings of short incremental ranges, such as a 50 ampere capacity difference between the successive breakers.

SUMMARY OF THE INVENTION

In accordance with this invention, a circuit breaker is provided comprising a circuit breaker structure supported within a housing and having a pair of separable contacts operable to open and close an electric circuit, a releasable mechanism, manually operable means operable when the releasable mechanism is in a latched position to open and close the contacts, trip means operable automatically in response to overload current conditions to release the releasable mechanism whereupon the releasable mechanism automatically moves the latched position to a tripped position to open the contacts, the manually operable means being operable to move the releasable mechanism from the tripped position to the latched position following release of the releasable mechanism, latch means operable between latching and unlatching positions to latch the releasable mechanism, the trip means including a trip bar rotatably mounted between tripped and untripped positions and biased in the latter position to hold the latch means in the latched position, a heat responsive bimetal element movable in response to overload current conditions in a path of deflection, the trip bar having a guide pin on which a member is slidably mounted, adjustable means for moving the member in a direction that is substantially normal to the path of deflection, and the member having a surface facing the bimetal element that is inclined at an angle to the direction of adjustment.

The advantage of the device of this invention is that it reduces the number of types, or ampere ratings, necessary to maintain a complete stock of circuit breakers.

DESCRIPTION OF THE PREFERRED EMBODIMENT

Figure 1:
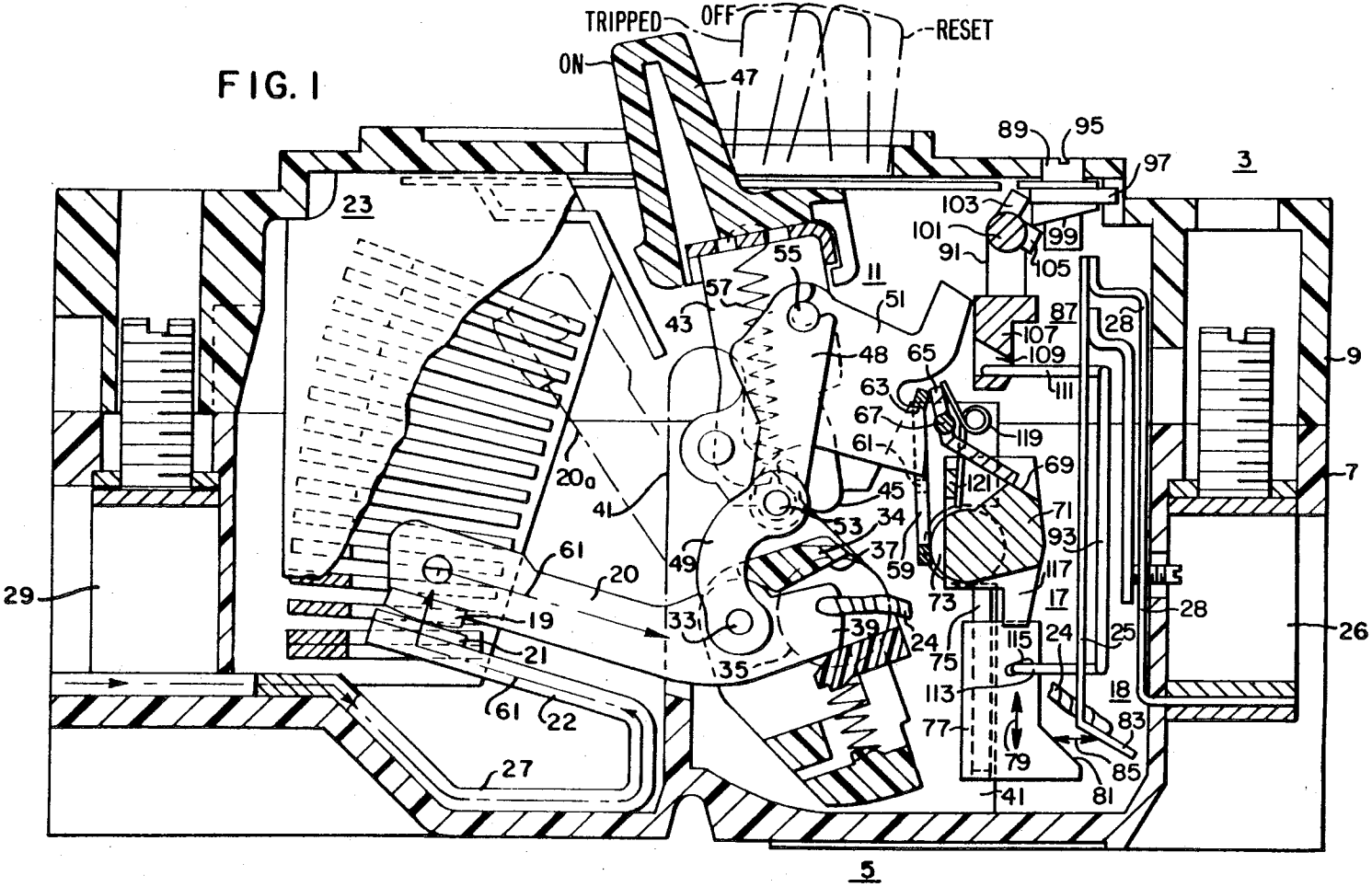
FIG. 1 is a vertical sectional view through a multipole current limiting circuit breaker constructed according to the principles of this invention, showing the contacts in the closed position.

A three-pole circuit breaker, generally indicated at 3 in FIG. 1, comprises an insulating housing 5 including a base 7 and a cover 9 which is secured to the base in a conventional manner such as by screws (not shown). Although the principal of this invention is applicable to a single pole circuit breaker, it is usually applicable to a multi-pole unit for which reason the housing 3 comprises insulating barriers separating the housing into three adjacent side-by-side pole unit compartments in a manner well known in the art.

Within the housing a circuit breaker mechanism 11 is mounted within the center pole unit of the housing and comprising a single operating mechanism 13 and a single latch mechanism 15. The circuit breaker mechanism 11 also comprises, in each of the three pole units, a separate thermal device 17 and a heat responsive bimetal element 18.

Each pole of the circuit breaker is provided with a pair of separable contacts 19 and 21, attached to upper and lower contact arms 20 and 22, respectively. An arc extinguishing unit or arc chute 23 is also provided in each pole unit. The upper contact 19 is electrically connected, through the upper contact arm 20, to a shunt 24 which is connected through the bimetal element 18 and conductor 28, to a terminal 26.

The lower contact 21 is connected through the lower contact arm 22 and a conducting strip 27 to a terminal 29. With the circuit breaker 3 in the closed position, an electrical circuit exists from the terminal 29 through the several items 27, 22, 21, 19, 20, 24, 18, 28 to the terminal 26.

The contact arm 20 is pivotally connected at pivot 33 to a rotatable carriage 34 which is fixedly secured to an insulating rotatable tie bar 35. The carriage 34 includes a slot or pocket 37 in which an end portion 39 of the arm 20 is rotatably mounted on the pivot 33. The arm 20 and the carriage 34 rotate as a unit with the tie bar 35 during normal current conditions through the circuit breaker.

The single operating mechanism 11 is positioned in the center pole unit of the three-pole circuit breaker and is supported on a pair of rigid support plates 41 (one of which is shown) that are fixedly secured in the base 7 in the center pole unit of the breaker. An inverted U-shaped operating lever 43 is pivotally supported on the spaced plates 41 with the ends of legs of the lever positioned in U-shaped notches 45 of the plates. The operating lever 43 includes a handle 47 of molded electrically insulating material. The handle 47 is movable between the positions of ON, TRIPPED, OFF and RESET.

The contact arm 20 for the center pole unit is operatively connected by means of a toggle comprising an upper toggle link 48 and lower toggle link 49 to a releasable cradle member 51. The toggle links are pivotally interconnected by means of a knee pivot pin 53. The lower toggle link 49 is pivotally connected to the carriage 34 of the center pole unit by the pin 33 and the upper toggle link is pivotally connected to the releasable cradle member 51 by a pivot pin 55. Overcenter operating springs 57 are connected under tension between the pivot knee pin 53 and the bight portion of the operating lever 43.

The contacts 19, 21 are manually opened by movement of the handle 47 from the ON position (FIG. 1) to an OFF position to the right of that shown in FIG. 1. Movement of the handle 47 to the OFF position carries the line of action of the overcenter operating springs 57 to the right, causing collapse of the toggle links 48, 49 and to rotate the cross bar 35 in a clockwise direction to simultaneously move the contact arm 20 of the three pole units to the open position and thereby opening the contacts of the three pole units.

The contacts are manually closed by reverse manual movement of the handle to the left which movement moves the line of action of the overcenter springs 57 to the left to move the toggle links 48, 49 to the position shown in FIG. 1. This movement rotates the cross bar 35 in a counterclockwise direction to move the contact arms 20 of the three pole units to the closed position.

The releasable cradle members 51 is latched in the position shown in FIG. 1 by means of the latch lever of the latch mechanism 15 which lever is actuated by the trip device 17 that comprises the bimetal element 25. The trip mechanism 17 is capable of detecting both low level short circuit or overload current conditions and high level short circuit or fault current conditions. Upon the detection of any such condition to the bimetal element 25 rotates the latch mechanism 15 clockwise to initiate the trip operation of the operating mechanism 13.

Figure 2:
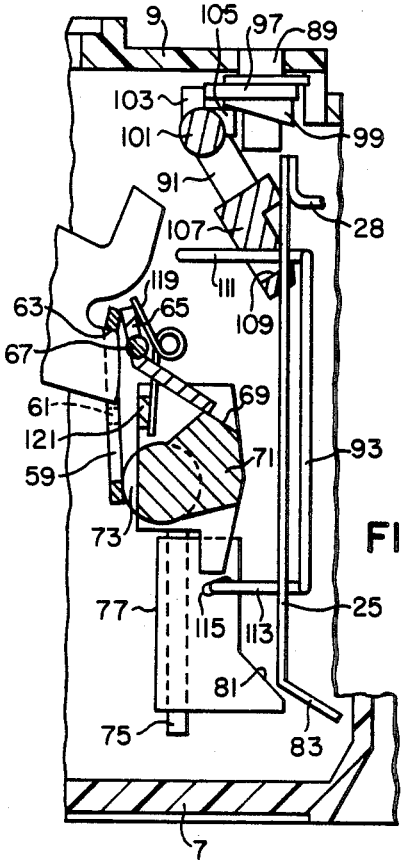
FIG. 2 is a fragmentary sectional view of thermal tripping elements in alternate positions.

In accordance with this invention the latch lever 59 which is pivotally mounted at 61 is movable into and out of engagement with a surface 63 of the cradle member 51 (FIGS. 1, 2). When the circuit breaker mechanism 11 is in the reset position (FIGS. 1, 2) the toggle springs 57 exert a rotational force on the lever 51 counterclockwise about the pivot 55. To prevent the latch lever 59 from rotating clockwise away from the surface 63 due to the force of the springs, a locking lever 65 holds the upper end of the latch lever in place. The locking lever is pivotally mounted at 67. The other end of the lever is retained in place by contact with a surface 69 of an enlarged portion 71 of a trip bar 73. Clockwise rotation of the trip bar 73 in response to movement of the bimetal element 25 to the position shown in FIG. 3 causes the locking lever 65 to rotate clockwise off of the surface 69 to cause the latching lever 59 to rotate clockwise out of engagement with the surface 63 of the cradle member 51, thereby tripping the circuit breaker. When that occurs the handle 47 moves to the trip position (FIG. 1) and the upper contact arm moves to the position 20a. Before the contacts 19, 21 can be closed the cradle member 51 must be rotated clockwise to reset the latch lever 59 in position by rotating the handle from the tripped to the reset position (FIG. 1).

In accordance with this invention, the thermal device 17 includes the trip bar 73 which is a molded insulating member haivng an elongated pin 75 extending downwardly at each pole position. The trip bar 73 comprises conventional trip bar functions as well as providing a member 77 slidably mounted on each pin 75. Each member 77 is slidably mounted on its corresponding pin 75 as indicated by the arrow 79. Each member 77 also comprises a ramp or inclined surface 81 facing an end portion 83 of the bimetal element 25. As the member 77 is moved up and down the pin 75, the gap 85 between the end portion 83 and the member 77 is varied (FIGS. 1, 2). This variation in the gap effectively changes the thermal rating of the circuit breaker by changing he amount of travel necessary by the bimetal element 25 (FIG. 3) to effect rotation of the trip bar 73 and resulting tripping of the circuit breaker.

In addition to the pin 75 and the member 77 the thermal device 17 includes adjustable means generally indicated at 87 for raising and lowering the member 77 on the pin 75 for each pole unit. The adjuster means includes an adjustment knob 89, a lever 91, and a link 93. The knob 89 comprises suitable means for rotation such as a screw-driver slot 95 having two mutually operably cams 97, 99. The lever 91 is rotatable clockwise and counterclockwise about an axis 101 and includes cam followers 103 and 105 which engage the cams 97, 99, respectively. The lower end of the lever 91 includes an enlarged portion 107 having a slot 109 in which is disposed an upper end portion 111 of the link 93. A lower end portion 113 of the link is disposed within a slot 115 of the member 77.

Figure 3:
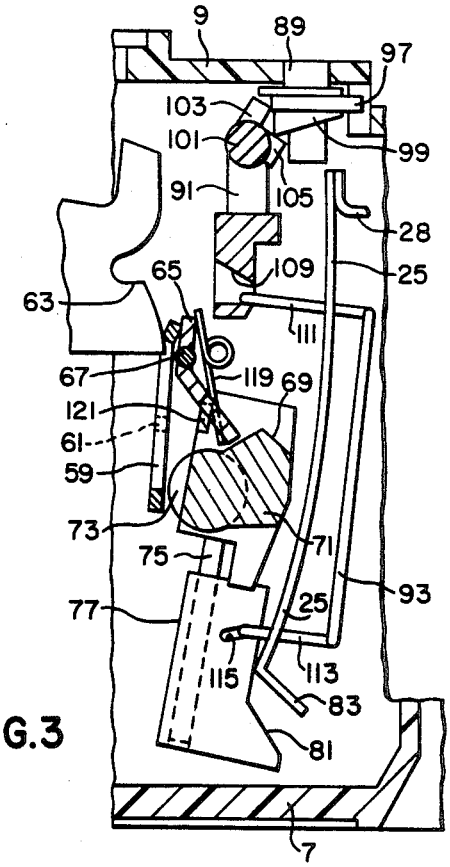
FIG. 3 is a fragmentary sectional view showing the thermal tripping elements in a tripped position.

As shown in FIG. 2, when the knob 89 is rotated the cam followers 103, 105 are mutually moved by the cams 97, 99 to rotate the lever 91 in either direction, such as, for example, counterclockwise to raise the member 77 on the pin 75 by elevating the link 93. As a result the end portion 111 slides through the slot 109 and the lower end portion 113 is slidably movable in the slot 115. By elevating the member 77 the gap between the inclined surface 81 and the lower end portion 83 of the bimetal 25 is reduced, thereby making the circuit breaker susceptible to smaller movements of the bimetal (FIG. 3).

Conversely, when the member 77 is in a lowermost position, such as shown in FIG. 1, the bimetal moves through a greater distance before contacting the member 77 and thereby rotating the trip bar 73.

To prevent rotation of the member 77 on the pin 75 the upper end of the member is guided between a pair of spaced flanges 117 (one of which is shown).

When the bimetal 25 cools sufficiently to return to the retracted position (FIG. 1) the trip bar 73 returns to its original position preparatory to resetting of the circuit breaker. For that purpose a torsion spring 119 bears against the locking lever 65 which inturn rotates the latch lever 59 counterclockwise until the craddle member 51 is rotated downwardly to enable the upper end of the latching lever to be seated on the surface 63. Simultaneously, the lower end of the locking lever 65 is moved onto the surface 69 of the trip bar 73, thereby enabling the trip bar to rotate counterclockwise in response to pressure of the torsion spring 119 on a portion 121 of the trip bar 73.

Figure 4:
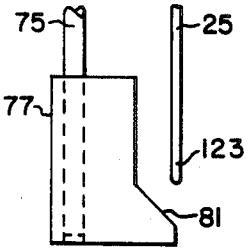

Another embodiment of the invention is shown in FIG. 4 in which similar numerals refer to similar parts. In this embodiment a lower end portion 123 of the bimetal element 25 extend in alignment with the upper portion of the bimetal element. Vertical movement of the member 77 varies the gap between the end portion 123 and the ramp or surface 81 of the member 77.

Figure 5:
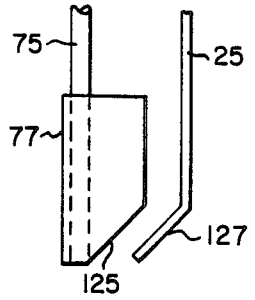
FIGS. 4 and 5 are fragmentary views of other embodiments.

Another embodiment of the invention is that shown in FIG. 5 in which the member 77 includes a ramp or surface 125 which is inclined at an angle downwardly and inwardly towards the axis of the pin 75, or at an angle such at 90° to that of the ramp or surface 91 (FIG. 2). Similarly a lower end portion 127 of the bimetal element 25 is inclined at an angle substantially parallel to the angle of the surface 125 so that raising and lowering of the member 77 varies the gap between the surface 125 and the lower end portion 127 in the manner similar to that shown in FIGS. 1, 2.

In conclusion, the device of this invention enables variation in a gap between the bimetal element and a trip bar to effectively change the thermal rating of the circuit breaker by changing the amount of travel necessary for the bimetal element to effect a tripping operation.

What is claimed is:

1. A circuit breaker having means for varying the thermal rating thereof comprising:

a housing;

a circuit breaker structure supported in the housing;

the circuit breaker structure having a pair of separable contacts operable to open and close an electric circuit;

a releasable mechanism;

manually operable means manually operable when the releasable mechanism is in a latched position to open and close the contacts;

trip means operable automatically in response to overload current conditions above a predetermined value to release the releasable mechanism whereupon the releasable mechanism automatically moves from the latched position to a tripped position to open the contacts;

the manually operable means being operable to move the releasable mechanism from the tripped position to the latched position following release of the releasable mechanism;

latch means operable between latching and unlatching positions to latch the releasable mechanism;

the trip means including a trip bar rotatably mounted between tripped and untripped positions and biased in the latter position to hold the latch means in the latched position;

a heat responsive bimetal element movable in response to overload current conditions in a path of deflection;

the trip bar having a member movably mounted in the path of deflection of the bimetal element to vary the spacing therebetween;

adjustable means for moving the member in a direction that is substantially normal to the path of deflection; and the member having a surface facing the bimetal element that is included at an angle to the direction of adjustment.

2. The circuit breaker of claim 1 in which the bimetal element includes an end portion inclined at an angle to the direction of adjustment.

3. The circuit breaker of claim 2 in which the surface is inclined toward the bimetal element.

4. The circuit breaker of claim 3 in which the end portion is inclined at an angle away from the member.

5. The circuit breaker of claim 4 in which the trip bar includes a guide pin on which the member is slidably mounted.

6. The circuit breaker of claim 5 in which adjustable means includes an adjusting lever and in which a link extends between the member and the level for moving the member on the guide pin.

7. The circuit breaker of claim 6 in which adjustment means includes an adjustment knob having cam means for moving the lever.

8. The circuit breaker of claim 7 in which the lever includes a pair of cam followers extending from the lever and the cam means including first cam coupled with one of the cam followers and a second cam coupled with the other cam follower, and the cams operating simultaneously on the corresponding cam followers.

9. The circuit breaker of claim 8 in which the cam followers extend from the lever in arcuately spaced directions to enable the first cam to rotate the lever in one direction and the second cam to rotate the lever in the opposite direction.

* * * * *